US011605327B2

(12) United States Patent
Lee

(10) Patent No.: US 11,605,327 B2
(45) Date of Patent: Mar. 14, 2023

(54) DISPLAY DEVICE AND METHOD OF DRIVING THE SAME

(71) Applicant: SAMSUNG DISPLAY CO., LTD., Yongin-si (KR)

(72) Inventor: Yoon Young Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 144 days.

(21) Appl. No.: 17/121,021

(22) Filed: Dec. 14, 2020

(65) Prior Publication Data

US 2021/0264834 A1 Aug. 26, 2021

(30) Foreign Application Priority Data

Feb. 24, 2020 (KR) ..... 10-2020-0022473

(51) Int. Cl.
*G09G 3/20* (2006.01)

(52) U.S. Cl.
CPC ..... *G09G 3/20* (2013.01); *G09G 2300/08* (2013.01); *G09G 2310/0267* (2013.01); *G09G 2310/0275* (2013.01); *G09G 2310/08* (2013.01); *G09G 2330/021* (2013.01); *G09G 2330/026* (2013.01)

(58) Field of Classification Search
None
See application file for complete search history.

(56) References Cited

U.S. PATENT DOCUMENTS

| | | | | |
|---|---|---|---|---|
| 9,013,380 | B2 | 4/2015 | Seo et al. | |
| 2017/0061885 | A1* | 3/2017 | Park | G09G 3/3266 |
| 2019/0318705 | A1 | 10/2019 | Lee et al. | |
| 2020/0175906 | A1* | 6/2020 | Lee | G09G 3/20 |

FOREIGN PATENT DOCUMENTS

| | | | |
|---|---|---|---|
| KR | 1020180120344 | A | 11/2018 |
| KR | 101992281 | B1 | 6/2019 |
| KR | 1020190119243 | A | 10/2019 |

* cited by examiner

*Primary Examiner* — Ifedayo B Iluyomade
(74) *Attorney, Agent, or Firm* — Cantor Colburn LLP

(57) ABSTRACT

A display device includes a display panel which displays an image, a data driver which supplies a plurality of data signals to the display panel, a first power supply which supplies a data driving voltage to the data driver through a first power supply line, and a second power supply which supplies a first driving voltage to the display panel through a second power supply line. The first power supply senses a voltage of the second power supply line and controls the supply of the data driving voltage based on a sensed voltage during an initial driving period, in which the first power supply generates the data driving voltage and the second power supply does not generate the first driving voltage.

18 Claims, 5 Drawing Sheets

| CODE | V_REF | CODE | V_REF |
|---|---|---|---|
| 0000 | 1.0V | 1000 | 1.8V |
| 0001 | 1.1V | 1001 | 1.9V |
| 0010 | 1.2V | 1010 | 2.0V |
| 0011 | 1.3V | 1011 | 2.5V |
| 0100 | 1.4V | 1100 | 3.0V |
| 0101 | 1.5V | 1101 | 3.5V |
| 0110 | 1.6V | 1110 | 4.0V |
| 0111 | 1.7V | 1111 | 4.5V |

DISPLAY DEVICE AND METHOD OF DRIVING THE SAME

This application claims priority to Korean Patent Application No. 10-2020-0022473, filed on, Feb. 24, 2020, and all the benefits accruing therefrom under 35 U.S.C. § 119, the content of which in its entirety is herein incorporated by reference.

BACKGROUND

1. Field

The disclosure relates to a display device and a method of driving the same.

2. Description of the Related Art

In general, a display device includes a power supply that converts main power of the display device to a driving voltage for a display panel or a driver and provides the driving voltage to the display panel or the driver. Pixels of the display panel receive the driving voltage from the power supply and emit light using the driving voltage.

SUMMARY

In a display device, the power supply may provide a short circuit protection ("SCP") function to prevent burnt or the like due to a short of a power supply line. Since a conventional power supply protection function is typically performed during driving (or startup) in which the driving voltage is supplied to the display panel, an abnormal state of the display panel occurs in an initial driving period before the driving voltage is supplied to the display panel. Therefore, abnormal light emission occurs or damage to the power supply due to an abnormal voltage may not be prevented.

Embodiments of the disclosure provide a display device and a method of driving the display device for preventing damage to a power supply and occurrence of an abnormal light emission due to occurrence of an abnormal state of the display panel during an initial driving period.

An embodiment of a display device according to the disclosure includes a display panel which displays an image, a data driver which supplies a plurality of data signals to the display panel, a first power supply which supplies a data driving voltage to the data driver through a first power supply line, and a second power supply which supplies a first driving voltage to the display panel through a second power supply line. In such an embodiment, the first power supply senses a voltage of the second power supply line and controls the supply of the data driving voltage base on a sensed voltage of the second power supply line during an initial driving period, in which the first power supply generates the data driving voltage and the second power supply does not generate the first driving voltage.

In an embodiment, the first power supply may include a voltage converter which converts a first input voltage supplied from an outside to generate the data driving voltage, and a voltage controller which outputs a shutdown signal to the voltage converter based on the sensed voltage of the second power supply line.

In an embodiment, the display device may further include a timing controller which provides a first control signal to the first power supply and a second control signal to the second power supply.

In an embodiment, the first power supply may be activated by the first control signal to generate the data driving voltage, and the second power supply may be activated by the second control signal to generate the first driving voltage.

In an embodiment, the second control signal may be supplied after the initial driving period after the first control signal is supplied.

In an embodiment, the voltage controller may include a comparator which compares the voltage of the second power supply line with a reference voltage, and a determiner which outputs the shutdown signal to the voltage converter in correspondence with an output signal of the comparator.

In an embodiment, the voltage controller may further include a reference voltage generator which provides the reference voltage selected by an input code to the comparator.

In an embodiment, the comparator may be activated during the initial driving period and deactivated after the initial driving period.

In an embodiment, the determiner may determine whether the sensed voltage of the second power supply line is greater than the reference voltage based on the output signal of the comparator, and when the sensed voltage of the second power supply line is equal to or greater than the reference voltage, the determiner may output the shutdown signal.

In an embodiment, the voltage converter may be deactivated in response to the shutdown signal, and may stop the supply of the data driving voltage.

In an embodiment, the voltage of the second power supply line may be transited to a ground voltage level after the supply of the data driving voltage is stopped.

In an embodiment, the second power supply may convert a second input voltage supplied from the outside to generate the first driving voltage and a second driving voltage, and may supply the second driving voltage to the display panel through a third power supply line, and the second driving voltage may be a voltage less than the first driving voltage and may be supplied later than the first driving voltage.

In an embodiment, the display device may further include a scan driver which supplies sequentially a plurality of scan signals to the display panel, and the first power supply may supply a scan driving voltage to the scan driver.

An embodiment of a method of driving a display device according to the disclosure includes supplying a data driving voltage to a data driver of the display device through a first power supply line in response to a first control signal, sensing a voltage of a second power supply line which supplies a first driving voltage to a display panel of the display device, and controlling a supply of the data driving voltage based on a sensed voltage of the second power supply line.

In an embodiment, controlling the sensed supply of the data driving voltage may include comparing the voltage of the second power supply line with a reference voltage, and stopping the supply of the data driving voltage when the sensed voltage of the second power supply line is equal to or greater than the reference voltage.

In an embodiment, the method may further include supplying the first driving voltage to the display panel through the second power supply line in response to a second control signal when the sensed voltage of the second power supply line is less than the reference voltage.

In an embodiment, the method may further include supplying a second driving voltage which is less than the first driving voltage to the display panel through a third power supply line after the first driving voltage is supplied.

In an embodiment, sensing the voltage of the second power supply line may be performed in an initial driving period in which the data driving voltage is generated and the first driving voltage is not generated.

In accordance with embodiments of the display device and the method of driving the display device according to the disclosure, the first power supply detects an abnormal state of the display panel and controls the supply of the data driving voltage based on a result of the detection of abnormal state by sensing a voltage of a power supply line during the initial driving period before the first driving voltage is provided to the display panel. Therefore, damage to the second power supply and occurrence of abnormal light emission in a driving initial of the display panel may be prevented.

BRIEF DESCRIPTION OF THE DRAWINGS

The above and other features of the disclosure will become more apparent by describing in further detail embodiments thereof with reference to the accompanying drawings, in which.

DETAILED DESCRIPTION

Figure 1:
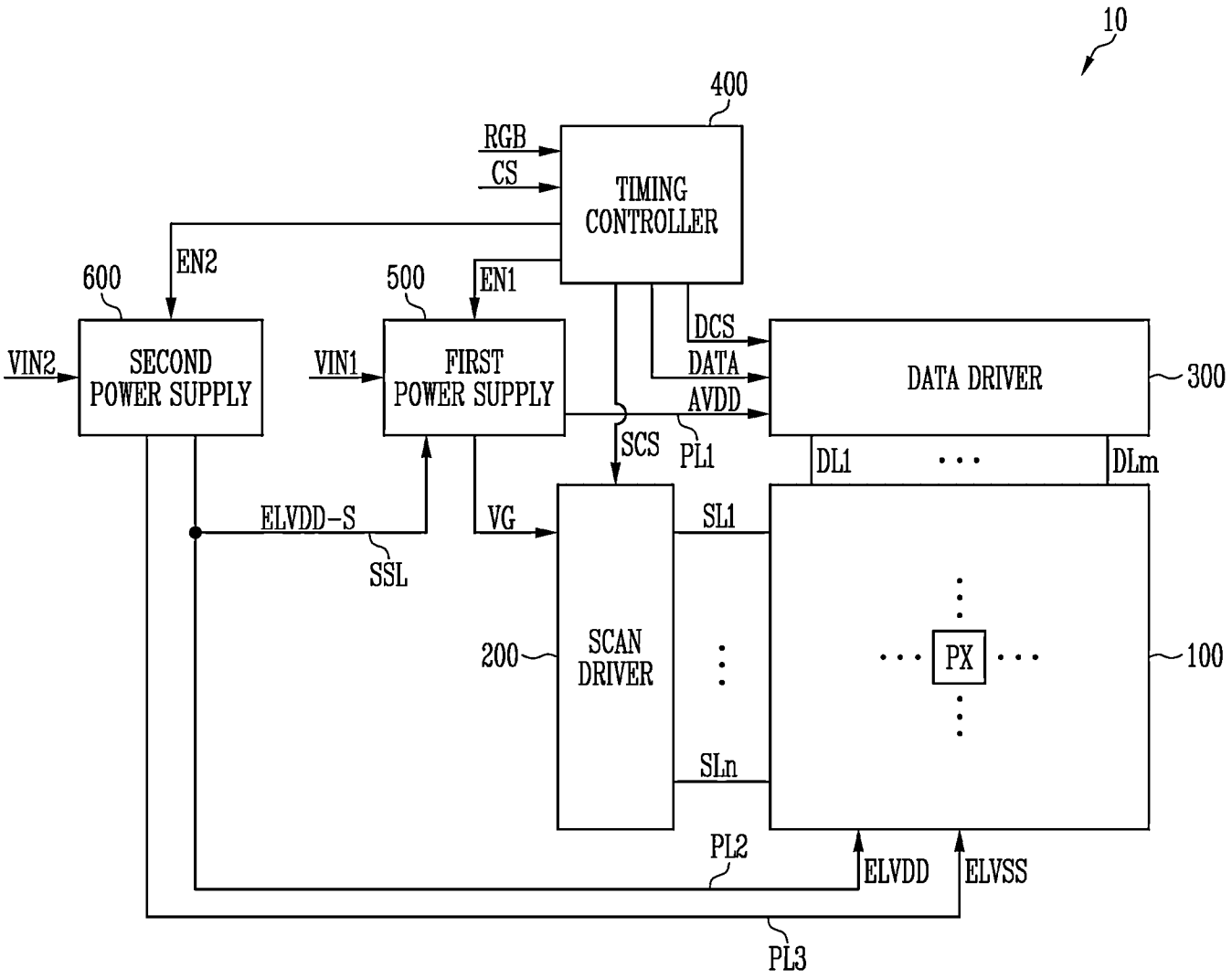
FIG. 1 is a diagram illustrating a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

In the following description, a case where a portion is connected to another portion includes not only a case where the portion is directly connected to the other portion, but also a case where another element is interposed therebetween. In addition, a portion that is not related to the disclosure is omitted in the drawings to clarify the description of the disclosure, and some components or waveforms are exaggerated for convenience of illustration and description.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

Figure 2:
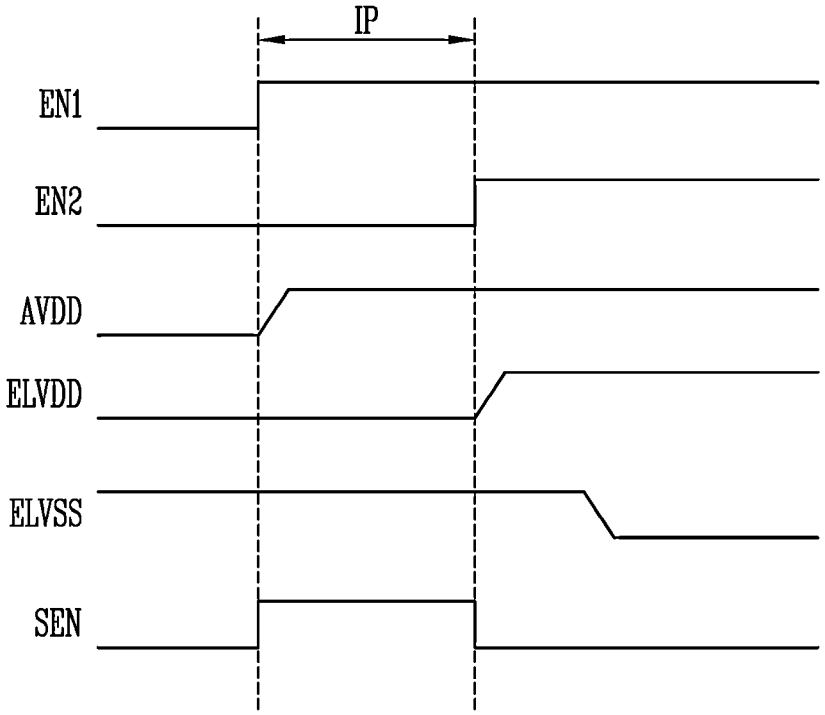
FIG. 2 is a waveform diagram illustrating an embodiment of a method of driving the display device shown in FIG. 1.

FIG. 1 is a diagram illustrating a display device according to an embodiment of the disclosure. FIG. 2 is a waveform diagram illustrating an embodiment of a method of driving the display device shown in FIG. 1.

Referring to FIG. 1, an embodiment of the display device 10 may include a display panel 100, a scan driver 200, a data driver 300, a timing controller 400, a first power supply 500, and a second power supply 600.

The display panel 100 may display an image. The display panel 100 may include at least one selected from various display elements such as an organic light emitting device (for example, an organic light emitting diode ("OLED")). Hereinafter, for convenience of description, embodiments where the display device 10 includes the organic light emitting device as a display element will be described in detail. However, the disclosure is not limited thereto, and the teachings herein may be applied to various types of display device such as a liquid crystal display ("LCD"), an electrophoretic display ("EPD"), and an inorganic light emitting display.

In an embodiment, the display panel 100 may include data lines DL1 to DLm (m is a positive integer), scan lines SL1 to SLn (n is a positive integer), and a pixel PX. The pixel PX may be disposed in an area defined or partitioned by the data lines DL1 to DLm and the scan lines SL1 to SLn. The pixel PX may be electrically connected to the data lines DL1 to DLm and the scan lines SL1 to SLn.

In one embodiment, for example, a pixel PX positioned in a first row and a first column may be connected to a first data line DL1 and a first scan line SL1. In such an embodiment, a pixel PX positioned in an n-th row and an m-th column may be connected to an m-th data line Dm and an n-th scan line Sn.

However, the pixel PX is not limited thereto. In one alternative embodiment, for example, the pixel PX may be connected to scan lines corresponding to adjacent rows (for example, a scan line corresponding to a previous row of a row including the pixel PX and a scan line corresponding to a subsequent row of the row including the pixel PX).

In an embodiment, the pixel PX may be electrically connected to a second power supply line PL2 and a third power supply line PL3 to receive a first driving voltage ELVDD and a second driving voltage ELVSS. Here, the first driving voltage ELVDD and the second driving voltage ELVSS may be voltages used for driving the pixel PX. The first driving voltage ELVDD may have a value greater than that of the second driving voltage ELVSS. In such an embodiment, an initialization voltage or the like may be further supplied to the pixel PX.

The pixel PX may emit light at a luminance corresponding to a data signal provided through a corresponding data line in response to a scan signal provided through a corresponding scan line.

The scan driver 200 may generate a plurality of scan signals based on a scan control signal SCS provided from the timing controller 400 and a scan driving voltage VG provided from the first power supply 500, and may simultaneously or sequentially provide the scan signals to the scan lines SL1 to SLn. The scan control signal SCS may be a signal for controlling an operation of the scan driver 200 and may include a start signal, clock signals, and the like. In one embodiment, for example, the scan driver 200 may sequentially generate and output the scan signals corresponding to the start signal (for example, a signal having the same or similar waveform as the start signal) using the clock signals. In an embodiment, the scan driver 200 may include a shift register, a level shifter, an output buffer, and the like, but is not limited thereto. The scan driver 200 may be disposed or formed on one area of the display panel 100 or may be implemented as an integrated circuit and mounted on a flexible circuit board to be connected to the display panel 100.

The data driver 300 may generate a data voltage of an analog format based on data control signal DCS and output image signal DATA, which are provided from the timing controller 400, and based on a data driving voltage AVDD provided through a first power supply line PL1 from the first power supply 500, and may apply a data voltage to the data lines DL1 to DLm. In an embodiment, the data control signal DCS may be a signal for controlling an operation of the data driver 300 and may include a load signal, a start signal, clock signals, or the like.

In an embodiment, the data driver 300 may include a gamma block for generating a plurality of gamma voltages and a data driving block for generating the data voltage based on the gamma voltages. The data driving block may include a shift register, a latch block, a digital-analog converter ("DAC"), an output buffer, or the like. The data driver 300 may be implemented as an integrated circuit ("IC") (for example, a driver IC), or may be mounted on a flexible circuit board to be connected to the display panel 100.

The timing controller 400 may receive an input control signal CS and an input image signal RGB for each frame from an image source such as an external graphic processor. The input image signal RGB may include grayscale values corresponding to each of the pixels PX. The input control signal CS may include a vertical synchronization signal, a horizontal synchronization signal, a main clock signal, a data enable signal, or the like.

The timing controller 400 may generate an output image signal DATA of a digital format that satisfies an operation condition of the display panel 100 based on the input image signal RGB and provide the output image signal DATA to the data driver 300. In an embodiment, the timing controller 400 may render the input image signal RGB to correspond to the specification of the display device 10. In one embodiment, for example, the external processor may provide a red grayscale value, a green grayscale value, and a blue grayscale value with respect to each unit dot. In one embodiment, for example, where the display panel 100 has an RGB stripe structure, the pixel may correspond to each grayscale value one to one. In such an embodiment, rendering of the input image signal RGB may be omitted. However, in an alternative embodiment, where the display panel 100 has a pentile structure, since adjacent unit dots share the pixel, the pixel may not correspond to each grayscale value one to one. In such an embodiment, rendering of the input image signal RGB may be performed. The output image signal DATA that is rendered or not rendered by the timing controller 400 may be provided to the data driver 300.

In an embodiment, the timing controller 400 may generate the scan control signal SCS for controlling a driving timing of the scan driver 200 and the data control signal DCS for controlling a driving timing of the data driver 300 based on the input control signal CS, and may provide the scan control signal SCS and the data control signal DCS to the scan driver 200 and the data driver 300, respectively. The timing controller 400 may generate a first control signal EN1 for controlling a driving timing of the first power supply 500 and a second control signal EN2 for controlling a driving timing of the second power supply 600, and may provide the first control signal EN1 and the second control signal EN2 to the first power supply 500 and the second power supply 600, respectively.

The first power supply 500 and the second power supply 600 may include or defined by a power management IC ("PMIC"). The first power supply 500 may be activated by the first control signal EN1, and the second power supply 600 may be activated by the second control signal EN2. In an embodiment, the second control signal EN2 may be supplied after a preset initial driving period IP after the first control signal EN1 is supplied. In such an embodiment, the initial driving period IP may be a period in which the first power supply 500 is activated by the first control signal EN1 and the second power supply 600 is deactivated.

The first power supply 500 may manage a magnitude and a sequence of driving voltages provided to the scan driver 200 and the data driver 300. The first power supply 500 may convert the first input voltage VIN1 provided from an outside into the scan driving voltage VG and the data driving voltage AVDD based on the first control signal EN1 supplied from the timing controller 400.

The scan driving voltage VG may be a voltage for driving the scan driver 200. In one embodiment, for example, the scan driving voltage VG may include a high direct current ("DC") voltage and a low DC voltage used for driving the scan driver 200. The data driving voltage AVDD may be a voltage for driving the data driver 300. The data driving voltage AVDD may be provided to the data driver 300 through the first power supply line PL1. In one embodiment, for example, the data driving voltage AVDD may be divided into a plurality of gamma voltages by the data driver 300, but is not limited thereto.

The second power supply 600 may manage a magnitude and a sequence of driving voltages provided to the display panel 100. The second power supply 600 may convert a second input voltage VIN2 provided from the outside into the first driving voltage ELVDD and the second driving voltage ELVSS based on the second control signal EN2 supplied from the timing controller 400. The first driving voltage ELVDD may be provided to the display panel 100 through the second power supply line PL2, and the second driving voltage ELVSS may be provided to the display panel 100 through the third power supply line PL3. In an embodiment, the second driving voltage ELVSS may be a voltage less than the first driving voltage ELVDD, and may be supplied later than the first driving voltage ELVDD. In such an embodiment, after the first driving voltage ELVDD is supplied, the second driving voltage ELVSS may be supplied.

In an embodiment of the disclosure, the first power supply 500 may sense a voltage ELVDD-S of the second power supply line PL2 through a sensing line SSL during a predetermined period. In such an embodiment, the period in which the first power supply 500 senses the voltage ELVDD-S of the second power supply line PL2 may be the initial driving period IP, and a sensing signal SEN may be provided during the initial driving period IP. The first power supply 500 may sense the voltage ELVDD-S of the second power supply line PL2 in correspondence with the sensing signal SEN. The first power supply 500 may detect an abnormal state of the display device 10 during the initial driving period IP, and control supply of the data driving voltage AVDD based on a detection result.

In one embodiment, for example, during the initial driving period IP before the data driving voltage AVDD is supplied from the first power supply 500 and the first driving voltage ELVDD is supplied from the second power supply 600, the voltage ELVDD-S of the second power supply line PL2 may be in a ground voltage level. However, when the display device 10 is in the abnormal state, such as a case where some configurations in the display panel 100 are instantaneously shorted or the display device is abnormally ended, the data driving voltage AVDD provided to the data driver 300 may be applied to the second power supply line PL2 through the data lines DL1 to DLm and the pixel PX.

The data driving voltage AVDD may have a voltage equal to or greater than a rated voltage of the second power supply 600 and may be applied to the second power supply 600 through the second power supply line PL2. Herein, the rated voltage of the second power supply 600 may be a predetermined voltage that may damage the second power supply 600 if being applied thereto. That is, the second power supply 600 may be damaged by the data driving voltage AVDD applied in the abnormal state of the display device 10. Accordingly, in such an embodiment, the first power supply 500 may sense the voltage ELVDD-S of the second power supply line PL2, and may control the supply of the data driving voltage AVDD to prevent damage to the second power supply 600. An operation of the first power supply 500 will hereinafter be described in greater detail with reference to FIGS. 3 to 6 below.

Figure 3:
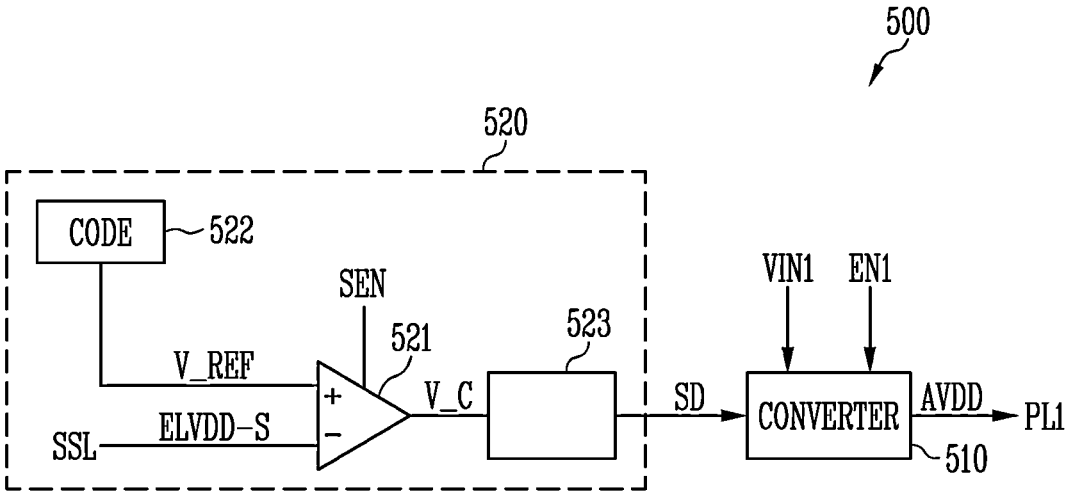
FIG. 3 is a block diagram illustrating an embodiment of a first power supply of FIG. 1.
Figures 4, 5:
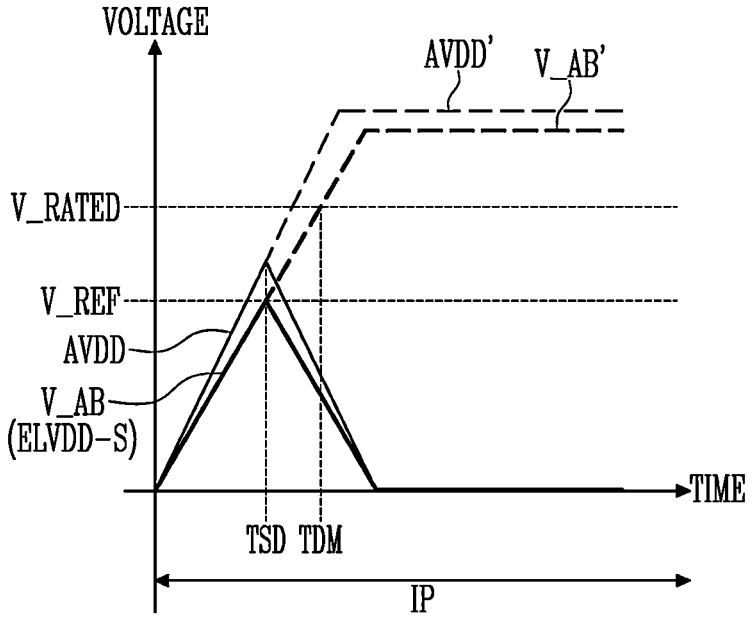
FIG. 4 is a diagram illustrating an embodiment of an input code input to a reference voltage generator of FIG. 3 and a reference voltage according to the input code.
FIG. 5 is a diagram for describing an embodiment of a method of controlling a data driving voltage of the first power supply shown in FIG. 3.

FIG. 3 is a block diagram illustrating an embodiment of the first power supply of FIG. 1. FIG. 4 is a diagram illustrating an embodiment of an input code input to a reference voltage generator of FIG. 3 and a reference voltage according to the input code.

Referring to FIGS. 1 to 4, an embodiment of the first power supply 500 may include a voltage converter 510 and a voltage controller 520.

The voltage converter 510 may convert the first input voltage VIN1 supplied from the outside into the data driving voltage AVDD based on the first control signal EN1 provided from the timing controller 400. In an embodiment, the voltage converter 510 may include a boost power converter (e.g., a boost DC-DC converter) or the like. The voltage converter 510 may supply the data driving voltage AVDD to the data driver 300 through the first power supply line PL1 in response to the first control signal EN1.

In such an embodiment, the voltage converter 510 may receive a shutdown signal SD from the voltage controller 520. The voltage converter 510 may be deactivated in response to the shutdown signal SD, and may stop the supply of the data driving voltage AVDD.

In an embodiment, the voltage controller 520 may include a comparator 521, a reference voltage generator 522, and a determiner 523.

One input terminal of the comparator 521 may be connected to the reference voltage generator 522, and another input terminal of the comparator 521 may be connected to the sensing line SSL. The sensing line SSL may be a detection line that is connected between the display panel 100 and the second power supply 600 and connected to the second power supply line PL2 that supplies the first driving voltage ELVDD to the display panel 100.

The comparator 521 may compare a reference voltage V_REF provided from the reference voltage generator 522 with the voltage ELVDD-S of the second power supply line PL2 measured through the sensing line SSL, and may output a comparison value V_C based on a comparison result to the determiner 523. The comparator 521 may be activated by the sensing signal SEN to output a signal corresponding to a difference between the voltage ELVDD-S of the second power supply line PL2 and the reference voltage V_REF during the initial driving period IP.

The reference voltage generator 522 may generate the reference voltage V_REF corresponding to the input code CODE and provide the generated reference voltage V_REF to the comparator 521. In an embodiment, as shown in FIG. 4, the input code CODE may be data of 4 bits, but is not limited thereto. In an embodiment, the input code CODE may be a value that is set in advance in a process of manufacturing the display device 10, but may also be a value that is separately set in a process of using the display device 10 after the display device 10 is manufactured. The reference voltage V_REF may be set to a voltage value in a range of about 1 volt (V) to about 4.5 V in correspondence with the input code CODE, but is not limited thereto.

The determiner 523 may detect the abnormal state of the display device 10 (or the display panel 100) based on a signal (for example, the comparison value V_C) output from the comparator 521 based on the comparison result. The determiner 523 may determine whether an abnormal voltage is detected in the second power supply line PL2 from the output signal of the comparator 521.

The determiner 523 may output the shutdown signal SD in correspondence with the comparison result. In one embodiment, for example, when the voltage ELVDD-S of the second power supply line PL2 is equal to or greater than the reference voltage V_REF, it may be determined that the display device 10 is in the abnormal state, and the determiner 523 may output the shutdown signal SD to the voltage converter 510. In such an embodiment, when the voltage ELVDD-S of the second power supply line PL2 is less than the reference voltage V_REF, it may be determined that the display device 10 is in a normal state, and the determiner 523 may not output the shutdown signal SD to the voltage converter 510.

In an embodiment, the determiner 523 may output a logic level signal for activating a shutdown operation in the voltage converter 510, to a control transistor. Herein, outputting the shutdown signal SD by the determiner 523 may be understood as outputting a signal for turning on the control transistor. In one embodiment, for example, when the abnormal state is not detected, the determiner 523 may output a signal having a turn-off level to the voltage converter 510, and when the abnormal state of the display panel 100 is detected, the determiner 523 may output a signal having a turn-on level to the voltage converter 510.

FIG. 3 illustrates an embodiment where only the comparator 521 is activated or deactivated by receiving the sensing signal SEN, but the disclosure is not limited thereto. In one alternative embodiment, for example, both of the comparator 521 and the determiner 523 may receive the sensing signal SEN, or only the determiner 523 may receive the sensing signal SEN to be activated or deactivated.

In an embodiment, the comparator 521 and the determiner 523 may be separate elements as shown in FIG. 3, but is not limited thereto. In an alternative embodiment, the comparator 521 and the determiner 523 may be configured in a single element or IC chip. In another alternative embodiment, the determiner 523 may be omitted. In such an embodiment, the output terminal of the comparator 521 may be connected to the voltage converter 510 to directly output the comparison value V_C.

In an embodiment, as described above, the voltage controller 520 may output the shutdown signal SD, and the voltage converter 510 may be deactivated in correspondence with the shutdown signal SD and may stop the supply of the data driving voltage AVDD. Therefore, damage to the second power supply 600 due to the data driving voltage AVDD in the abnormal state of the display device 10 may be effectively prevented.

Hereinafter, an embodiment of a method of controlling the data driving voltage AVDD of the first power supply 500 will be described in detail with reference to FIG. 5.

FIG. 5 is a diagram for describing an embodiment of the method of controlling the data driving voltage of the first power supply shown in FIG. 3. In particular, FIG. 5 specifically shows changes of the data driving voltage and the voltage of the second power supply line according to the abnormal state of the display device in the initial driving period.

Referring to FIGS. 1, 3, and 5, when the display device 10 is in the abnormal state, as the data driving voltage AVDD is provided to the data driver 300 in the initial driving period IP, the voltage ELVDD-S of the second power supply line PL2 may increase. Accordingly, an abnormal voltage V_AB may be applied to the second power supply 600 connected to the second power supply line PL2. The abnormal voltage V_AB may be a voltage substantially the same as the voltage ELVDD-S of the second power supply line PL2.

In the abnormal state of the display device 10, when a data driving voltage AVDD' is continuously supplied to the data driver 300, an abnormal voltage V_AB' applied to the second power supply 600 may also continuously increases. The abnormal voltage V_AB' may increase to a voltage equal to or greater than a rated voltage V_RATED of the second power supply 600 after a damage time point TDM, and circuit elements inside the second power supply 600 may be damaged due to the abnormal voltage V_AB' of a voltage greater than the rated voltage V_RATED.

As described above, in an embodiment, the voltage controller 520 may provide the shutdown signal SD to the voltage converter 510 to prevent the second power supply 600 from being damaged. A shutdown time point TSD at which the shutdown signal SD is output may be a time point at which the voltage ELVDD-S (or the abnormal voltage V_AB) of the second power supply line PL2 becomes equal to the reference voltage V_REF. That is, the first power supply 500 may prevent appliance of a voltage equal to or greater than the reference voltage V_REF to the second power supply 600.

After the shutdown time point TSD, in response to the shutdown signal SD, the first power supply 500 may be deactivated and the supply of the data driving voltage AVDD may be stopped. The data driving voltage AVDD may be transited to a voltage of the ground level. In such an embodiment, as the supply of the data driving voltage AVDD is stopped, the voltage ELVDD-S of the second power supply line PL2 may also gradually decrease and may be transited to the voltage of the ground level.

Since the reference voltage V_REF may be set to a value less than the rated voltage V_RATED of the second power supply 600, appliance of the abnormal voltage V_AB equal to or greater than the rated voltage V_RATED to the second power supply 600 may be effectively prevented.

Figure 6:
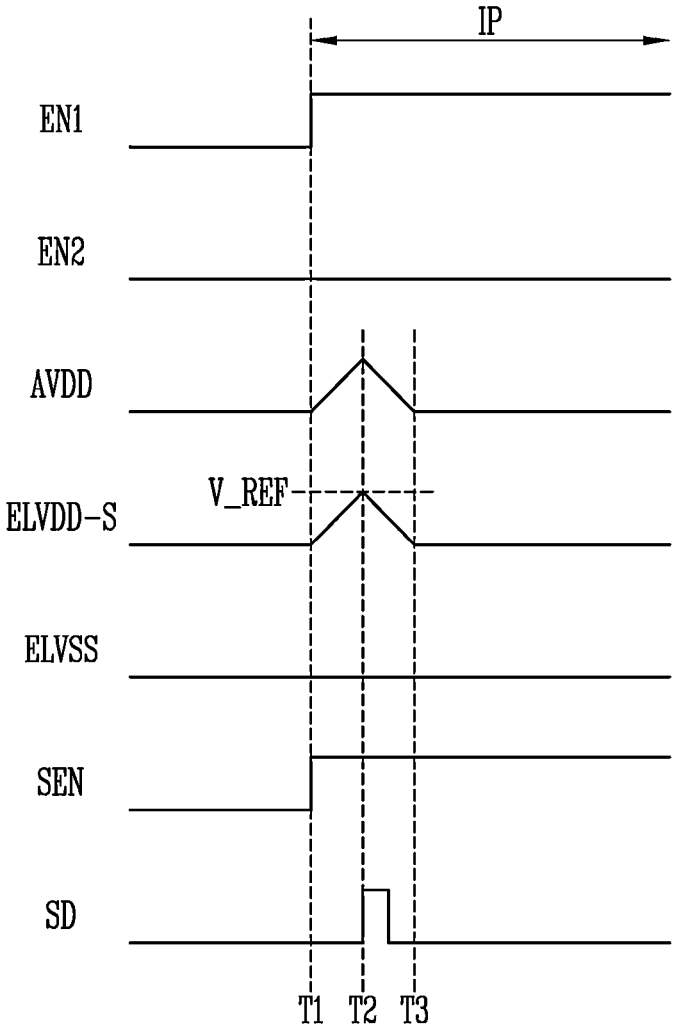
FIG. 6 is a waveform diagram illustrating an alternative embodiment of the method of driving the display device shown in FIG. 1.

FIG. 6 is a waveform diagram illustrating an alternative embodiment of the method of driving the display device shown in FIG. 1. In particular, FIG. 6 is a waveform diagram illustrating an embodiment of an operation of the display device in the abnormal state.

Referring to FIG. 6 together with FIGS. 1 to 3, at a first time point T1, the first control signal EN1 may be supplied and the initial driving period IP may be started. The initial driving period IP may be a period after the first control signal EN1 is supplied and before the second control signal EN2 is supplied. A period before the initial driving period IP may be an off period of the display device 10. That is, the period before the initial driving period IP may be a period in which other signals and voltages are not supplied to the display device 10.

The first power supply 500 may supply the data driving voltage AVDD to the data driver 300 in response to the first control signal EN1. The data driving voltage AVDD may be provided through the first power supply line PL1.

As the sensing signal SEN is activated during the initial driving period IP, the comparator 521 of the first power supply 500 may be activated after the first time point T1. The comparator 521 may sense the voltage ELVDD-S of the second power supply line PL2 connected between the display panel 100 and the second power supply 600 through the sensing line SSL. As described above, when the display device 10 is in the abnormal state, the voltage ELVDD-S of the second power supply line PL2 may also gradually increase according to the supply of the data driving voltage AVDD.

At a second time point T2, the voltage ELVDD-S of the second power supply line PL2 may be equal to the reference voltage V_REF, and the shutdown signal SD may be output to the voltage converter 510. In one embodiment, for example, the shutdown signal SD may be output during a short period as a signal of a pulse form. However, the shutdown signal SD is not limited thereto, and may be maintained as a high voltage level after the shutdown signal SD is output at the second time point T2.

When the shutdown signal SD is supplied, the supply of the data driving voltage AVDD may be stopped after the second time point T2. A magnitude of the data driving voltage AVDD may gradually decrease and decrease to the ground voltage level. When the supply of the data driving voltage AVDD is stopped, the voltage ELVDD-S of the second power supply line PL2 may also decrease.

After a third time point T3, the voltage ELVDD-S of the second power supply line PL2 may be stabilized. Although not shown in the drawing, after a predetermined period, supply of all signals and voltages of the display device may be stopped. In one embodiment, for example, supply of the first control signal EN1 and the sensing signal SEN may be stopped, and the first power supply 500 and the comparator 521 may be deactivated.

The abnormal state of the display device 10 may be resolved, driving of the display device 10 may be started again, and the display device 10 may be operated. In one embodiment, for example, the first power supply 500 may be activated again in response to the first control signal EN1 to generate the data driving voltage AVDD. At this time, the operation of the display device 10 in the normal state may be the same as described through the waveform diagram according to FIG. 2.

Figure 7:
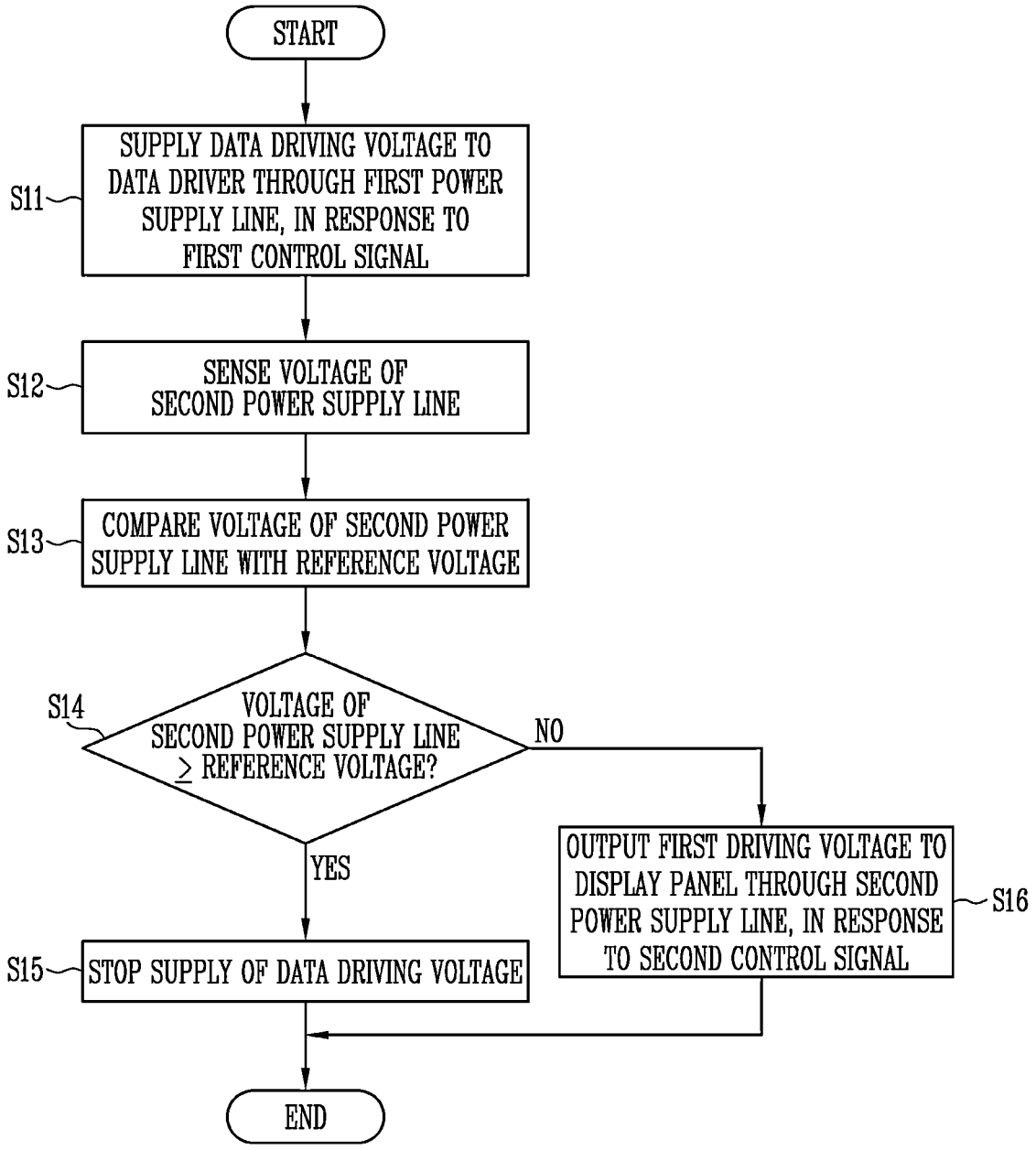
FIG. 7 is a flowchart illustrating the method of driving the display device according to an embodiment of the disclosure.

FIG. 7 is a flowchart illustrating the method of driving the display device according to an embodiment of the disclosure. In particular, FIG. 7 is a flowchart illustrating an embodiment of the method of driving the display device shown in FIG. 1.

Referring to FIG. 7 together with FIGS. 1, 3, and 6, in an embodiment of the method of driving the display device 10, the first power supply 500 of the display device 10 may supply the data driving voltage AVDD to the data driver 300 through the first power supply line PL1 in response to the first control signal EN1 (S11).

In an embodiment, the first power supply 500 may sense the voltage ELVDD-S of the second power supply line PL2 (S12). As described above, the second power supply line PL2 may be connected between the display panel 100 and the second power supply 600, and the first power supply 500 may sense the voltage through the sensing line SSL connected to the second power supply line PL2.

In an embodiment, the first power supply 500 may sense the voltage ELVDD-S of the second power supply line PL2 in the initial driving period IP in which the first control signal EN1 is activated and thus the data driving voltage AVDD is generated and the second control signal EN2 is deactivated and thus the first driving voltage ELVDD is not generated.

In such an embodiment, the comparator 521 of the first power supply 500 may be activated by the sensing signal SEN supplied in the initial driving period IP to sense the voltage ELVDD-S of the second power supply line PL2.

In an embodiment, the first power supply 500 may control the supply of the data driving voltage AVDD in correspondence with the voltage ELVDD-S of the sensed second power supply line PL2. In such an embodiment, the first power supply 500 may compare the magnitude of the voltage ELVDD-S of the second power supply line PL2 with the magnitude of the reference voltage V_REF (S13 and S14).

According to the comparison result, when the voltage ELVDD-S of the second power supply line PL2 is equal to or greater than the reference voltage V_REF, it may be determined that the display device 10 is in the abnormal state, and the first power supply 500 may stop the supply of the data driving voltage AVDD (S15).

In such an embodiment, when the voltage ELVDD-S of the second power supply line PL2 is less than the reference voltage V_REF, it may be determined that the display device 10 is in a normal state, and the second power supply 600 of the display device 10 may supply the first driving voltage ELVDD (S16). The first driving voltage ELVDD may be supplied to the display panel 100 through the second power supply line PL2. The second power supply 600 may further supply the second driving voltage ELVSS after the first driving voltage ELVDD is supplied. The second driving voltage ELVSS may be supplied to the display panel 100 through the third power supply line PL3.

As described above, the first power supply 500 may detect the abnormal state of the display device 10 (or the display panel 100) and control the supply of the data driving voltage AVDD according thereto by sensing the voltage ELVDD-S of the second power supply line PL2 during the initial driving period before the first driving voltage ELVDD is provided to the display panel 100. Therefore, damage to the second power supply 600 and occurrence of abnormal light emission in a driving initial of the display panel 100 may be effectively prevented.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel which displays an image;

a data driver which supplies a plurality of data signals to the display panel;

a first power supply which supplies a data driving voltage to the data driver through a first power supply line; and a second power supply which supplies a first driving voltage to the display panel through a second power supply line, wherein the first power supply senses a voltage of the second power supply line and controls a supply of the data driving voltage based on a sensed voltage of the second power supply line during an initial driving period, in which the first power supply generates the data driving voltage and the second power supply does not generate the first driving voltage.

2. The display device according to claim 1, wherein the first power supply comprises:

a voltage converter which converts a first input voltage supplied from an outside to generate the data driving voltage; and a voltage controller which outputs a shutdown signal to the voltage converter based on the sensed voltage of the second power supply line.

3. The display device according to claim 2, further comprising:

a timing controller which provides a first control signal to the first power supply and a second control signal to the second power supply.

4. The display device according to claim 3, wherein the first power supply is activated by the first control signal to generate the data driving voltage, and the second power supply is activated by the second control signal to generate the first driving voltage.

5. The display device according to claim 4, wherein the second control signal is supplied after the initial driving period after the first control signal is supplied.

6. The display device according to claim 2, wherein the voltage controller comprises:

a comparator which compares the sensed voltage of the second power supply line with a reference voltage; and a determiner which outputs the shutdown signal to the voltage converter in correspondence with an output signal of the comparator.

7. The display device according to claim 6, wherein the voltage controller further includes a reference voltage generator which provides the reference voltage selected by an input code to the comparator.

8. The display device according to claim 6, wherein the comparator is activated during the initial driving period and deactivated after the initial driving period.

9. The display device according to claim 6, wherein the determiner determines whether the sensed voltage of the second power supply line is greater than the reference voltage based on the output signal of the comparator, and when the sensed voltage of the second power supply line is equal to or greater than the reference voltage, the determiner outputs the shutdown signal.

10. The display device according to claim 6, wherein the voltage converter is deactivated in response to the shutdown signal, and stops the supply of the data driving voltage.

11. The display device according to claim 10, wherein the voltage of the second power supply line is transited to a ground voltage level after the supply of the data driving voltage is stopped.

12. The display device according to claim 1, wherein the second power supply converts a second input voltage supplied from the outside to generate the first driving voltage and a second driving voltage, and supplies the second driving voltage to the display panel through a third power supply line, and the second driving voltage is a voltage less than the first driving voltage and is supplied later than the first driving voltage.

13. The display device according to claim 1, further comprising:

a scan driver which sequentially supplies a plurality of scan signals to the display panel, wherein the first power supply supplies a scan driving voltage to the scan driver.

14. A method of driving a display device, the method comprising:

supplying a data driving voltage to a data driver of the display device through a first power supply line in response to a first control signal;

sensing a voltage of a second power supply line which supplies a first driving voltage to a display panel of the display device; and controlling a supply of the data driving voltage based on a sensed voltage of the second power supply line.

15. The method according to claim 14, wherein controlling the supply of the data driving voltage comprises:

comparing the sensed voltage of the second power supply line with a reference voltage; and stopping the supply of the data driving voltage when the sensed voltage of the second power supply line is equal to or greater than the reference voltage.

16. The method according to claim 15, further comprising:

supplying the first driving voltage to the display panel through the second power supply line in response to a second control signal when the sensed voltage of the second power supply line is less than the reference voltage.

17. The method according to claim 16, further comprising:

supplying a second driving voltage, which is less than the first driving voltage, to the display panel through a third power supply line after the first driving voltage is supplied.

18. The method according to claim 14, wherein sensing the voltage of the second power supply line is performed in an initial driving period, in which the data driving voltage is generated and the first driving voltage is not generated.

* * * * *